United States Patent [19]

Hyatt

[11] Patent Number: 5,069,058

[45] Date of Patent: Dec. 3, 1991

[54] SWAGING TOOL

[75] Inventor: Arthur J. Hyatt, Torrance, Calif.

[73] Assignee: Deutsch Metal Components, Los Angeles, Calif.

[21] Appl. No.: 492,282

[22] Filed: Feb. 28, 1990

Related U.S. Application Data

[63] Continuation of Ser. No. 291,003, Dec. 27, 1988, abandoned.

[51] Int. Cl.[5] ..... B21D 39/00

[52] U.S. Cl. ..... 72/413; 72/416; 72/402; 72/453.07; 72/453.16; 29/237

[58] Field of Search ..... 72/416, 413, 407, 402, 72/453.02, 453.07, 453.06, 453.16, 453.15, 414, 415, 410, 481, 470, 412; 29/237

[56] References Cited

U.S. PATENT DOCUMENTS

| | | | |
|---|---|---|---|
| Re. 31,084 | 11/1982 | Birks | 72/416 |
| 676,292 | 6/1901 | Wigtel | 72/416 |
| 798,284 | 8/1905 | Huber | 72/453.01 |
| 2,709,255 | 5/1955 | Frank | 72/412 |
| 3,101,766 | 8/1963 | Floyd, Jr. | 72/412 |
| 3,771,343 | 11/1973 | Dawson | 72/402 |
| 3,823,597 | 7/1974 | Hanback et al. | 72/402 |
| 3,848,451 | 11/1974 | Allin | 72/402 |
| 4,047,420 | 9/1977 | Edwards | 72/453.15 |
| 4,055,980 | 11/1977 | Churla | 72/410 |
| 4,067,224 | 1/1978 | Birks | 72/416 |
| 4,276,765 | 7/1981 | Yoneda | 72/416 |
| 4,292,833 | 10/1981 | Lapp | 72/410 |
| 4,528,740 | 7/1985 | Sassak | 72/416 |

FOREIGN PATENT DOCUMENTS

| | | | |
|---|---|---|---|
| 130672 | 5/1902 | Fed. Rep. of Germany | 72/453.01 |
| 1942413 | 4/1971 | Fed. Rep. of Germany | 72/410 |
| 2634569 | 2/1977 | Fed. Rep. of Germany | |
| 2813654 | 10/1978 | Fed. Rep. of Germany | 72/453.15 |
| 740125 | 1/1933 | France | 72/416 |
| 394 | 1/1983 | Japan | 72/416 |
| 727302 | 4/1980 | U.S.S.R. | 72/412 |
| 1323180 | 7/1987 | U.S.S.R. | 72/412 |
| 569942 | 6/1945 | United Kingdom | 72/414 |
| 806525 | 12/1958 | United Kingdom | 72/416 |
| 1179929 | 2/1970 | United Kingdom | 72/453.07 |

*Primary Examiner*—Daniel C. Crane

*Attorney, Agent, or Firm*—Pretty, Schroeder, Brueggemann & Clark

[57] ABSTRACT

A swaging tool is provided for swaging a fitting and joining two tubes together, especially fittings in difficult-to-access areas. A removable head of the tool holds a first die stationary with respect to a second die moved toward the first die by a double piston arrangement within the tool cylinder. The head is slideably removable directly from the cylinder by a tongue and groove configuration on the head and cylinder, respectively, which further includes head alignment means to ensure proper orientation of the dies. Additional die aligning features are provided, as well as other features, including means for recognizing tool wear, an improved return spring for retracting the pistons, tool insertion guides to facilitate assembly of the tool and other features which result in an extremely compact and lightweight tool.

27 Claims, 3 Drawing Sheets

FIG. 1.
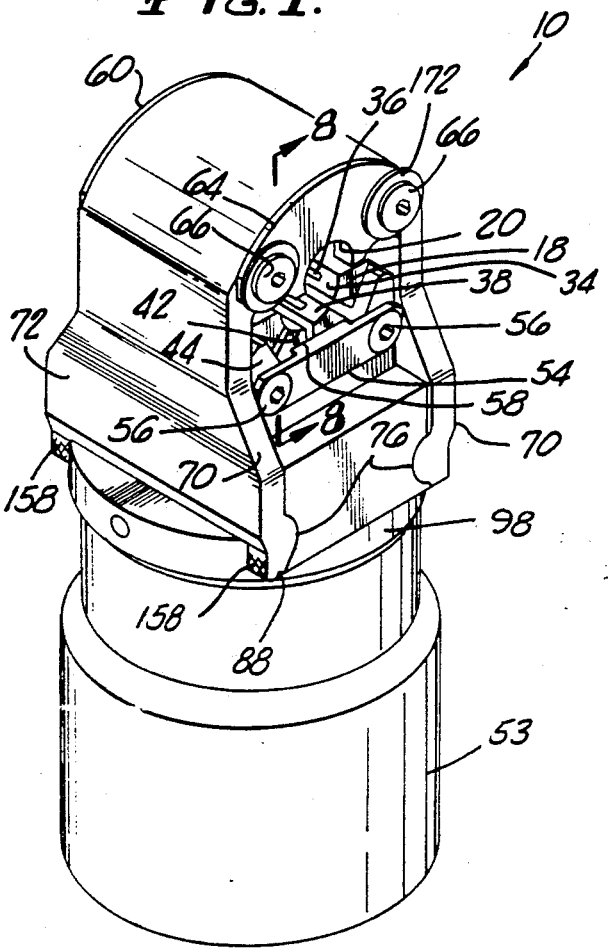
FIG. 9.
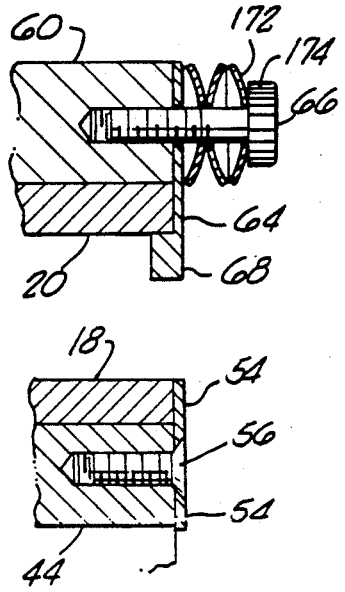
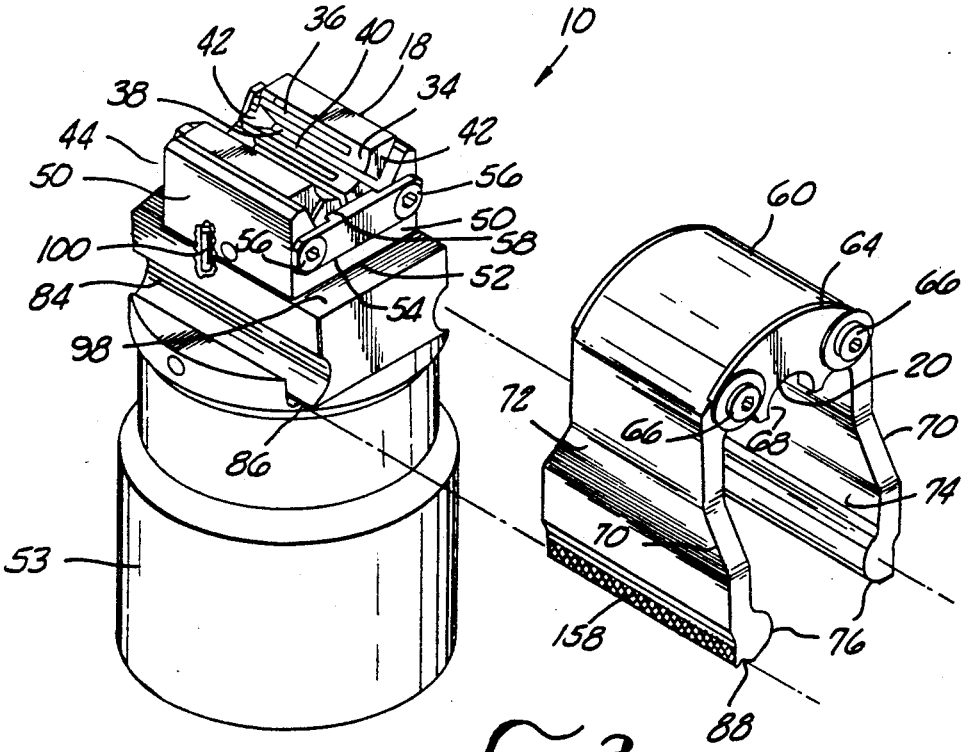
FIG. 3.

FIG. 5.
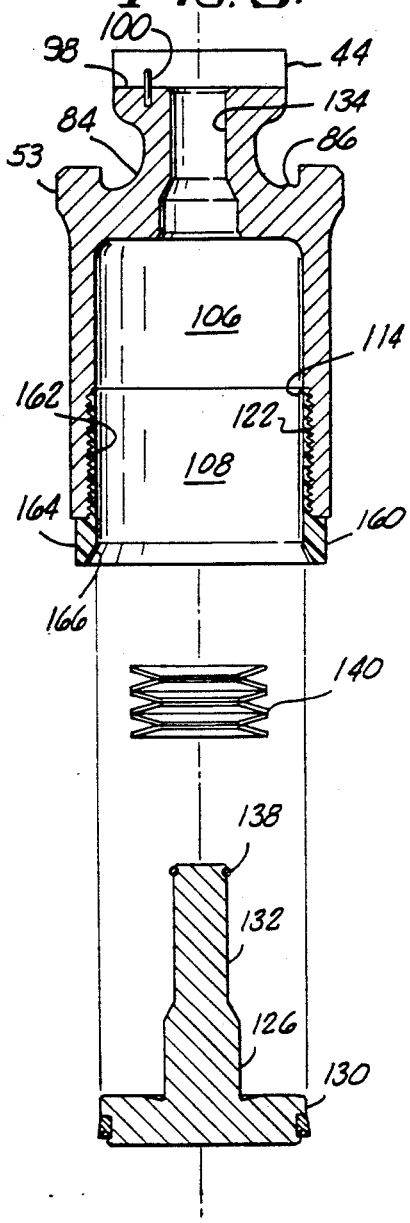
FIG. 6.
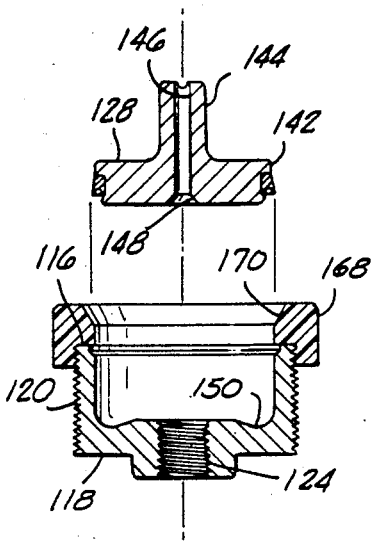
FIG. 7.
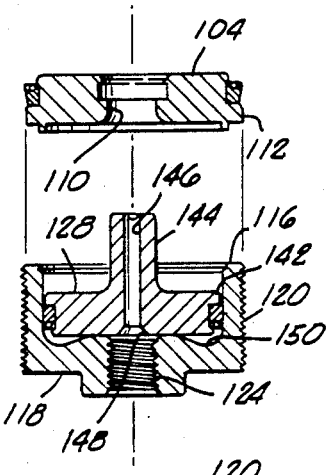
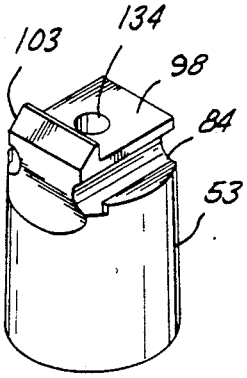
FIG. 10.
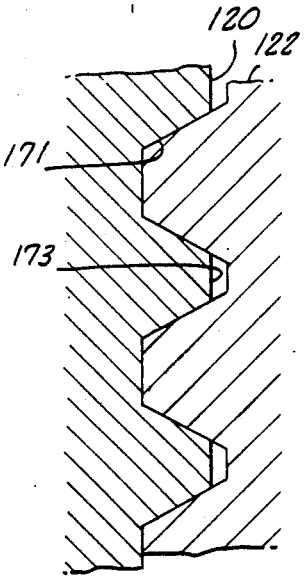
FIG. 11.
FIG. 2.
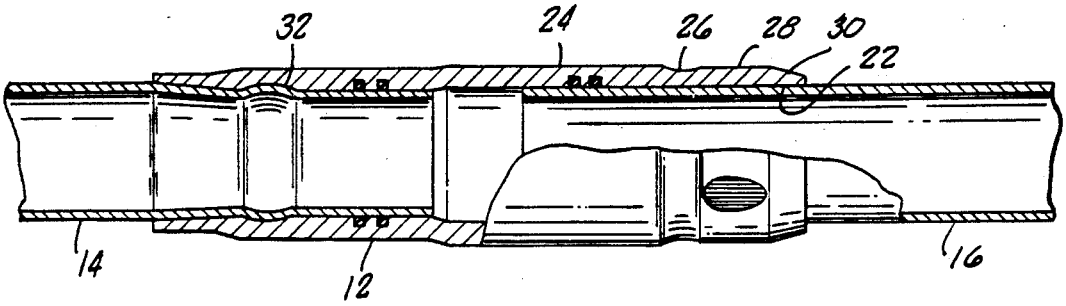

SWAGING TOOL

This application is a continuation of application Ser. No. 291,003, filed Dec. 27,1988, now abandoned.

BACKGROUND OF THE INVENTION

This invention relates to a swaging tool for use in swaging hydraulic fittings and the like.

Swaged hydraulic fittings for use in connecting tubes in hydraulic systems have been used for many years, especially in the aircraft industry. The tubes are inserted into a fitting usually comprising a cylindrical sleeve, and then the fitting is swaged with a swaging tool to produce a fluid-tight connection between the tubes. During the swaging operation, the fitting is compressed radially inwardly by the swaging tool. This causes annular ridges on the outer surface of the fitting to be flattened and transferred to its inner surface. As a result, annular indentations are formed in the tube, attaching it securely to the fitting.

In certain types of swaging operations, access to the fitting to be swaged may be very limited. As a result, there has existed a need for a swaging tool that will accomplish the swaging operation, yet be compact enough to gain access to the fitting. One relatively compact prior swaging tool is disclosed in U.S. Pat. No. 3,848,451, comprising an upper die held within a yoke and a lower die connected to the tool by a die holder. The yoke is removed by loosening a knurled nut, allowing the yoke to be separated from the remainder of the tool for initial connection to the fitting to be swaged. Despite the advances provided by this prior tool in terms of its relatively compact nature and versatility, there still remain situations where the ability of the tool to swage a fitting becomes very difficult and, at times, not possible.

In addition to the need for a more compact tool, there are numerous problems generally associated with the swaging tools of the prior art. One of these problems is the possibility that, during connection of the tool to the fitting to be swaged, one of the dies may be in an improper, reverse orientation in relation to the other die. This can cause incomplete and, therefore, unreliable swaging. A similar problem may occur when the dies are initially assembled in the tool itself, both in the factory and during use in the field, where one of the dies may be installed in a reverse orientation to the other die. Fittings that have been incompletely or defectively swaged must be discarded and replaced with a new fitting, and sometimes new tubing. This results in increased costs in terms of materials and labor, as well as increased inefficiency and related drawbacks.

It also is known that the lower die in many of the existing tools has a tendency to rotate or wobble during swaging. When die rotation or wobble occurs, it can damage the tool and result in a defectively swaged fitting To date, no adequate means has been developed to effectively prevent this problem. Recognizing tool wear resulting from repeated use of the tool over time could enable the operator to repair or replace the tool in time to prevent wear-related swaging problems from occurring. However, as yet no reliable means has been recognized to indicate tool wear. Numerous other problems are associated with the swaging tools of the prior art.

Accordingly, there has existed a need for a swaging tool that is even more versatile and compact in size to handle the various swaging situations confronting the operator. Furthermore, there has existed a need for a swaging tool that prevents a reversal of orientation of the dies with respect to each other, that prevents die rotation and wobble, and that indicates tool wear as a result of prolonged use. The present invention satisfies these and other needs, and provides further related advantages.

SUMMARY OF THE INVENTION

The present invention provides a swaging tool for use in swaging hydraulic fittings and the like to join two tubes together. The two-piece design of the tool, in combination with other features described below, contributes to a swaging tool that is extremely compact and lightweight, thus enabling the effective swaging of fittings in cramped quarters and difficult-to-access areas. The swaging tool of the present invention furthermore is intended to be simple to operate, reliable in use and less costly to manufacture.

The swaging tool comprises a lower die adapted to be moved toward an upper die to swage a workpiece therebetween. A head of the tool holds the first die stationary with respect to the movable second die during swaging, with the second die being supported by a die holder having its base attached to the tool cylinder. The head is connected directly to the cylinder by a pair of tongues on the head adapted to be moved into sliding engagement with a pair of grooves on the cylinder. The tongues and grooves extend in a direction substantially transverse to the longitudinal axis of the cylinder, thus enabling rapid assembly and disassembly of the head with respect to the cylinder.

The tool further includes provisions for aligning the dies with respect to each other. One of these provisions comprises head alignment means in the form of a rib extending along the length of one of the grooves and a trough extending along the length of a corresponding tongue. During assembly of the head to the cylinder, the rib moves into sliding engagement with the trough. This alignment feature prevents the head from being assembled to the cylinder in a reverse orientation, thereby ensuring that the upper die will be in a proper orientation with respect to the lower die. Another die aligning feature comprises a pin connected to the cylinder and projecting from its upper surface at a predetermined location adapted to be received in a hole in the lower surface of the die holder. Thus, during assembly of the die holder to the cylinder, it may be properly assembled only one way. This ensures correct orientation of the dies with respect to each other and, further, tends to prevent rotation of the lower die in the die holder during swaging. In an alternative embodiment to the pin and hole combination discussed above, the cylinder has an upwardly projecting tapered shoulder designed to abut against one end of the die holder to align it on the cylinder and inhibit undesirable rotation.

A pair of pistons within the cylinder are adapted to move the lower die toward the upper die to swage the fitting. The cylinder is divided into upper and lower chambers by a partition. More specifically, an upper piston having a head reciprocally retained within the upper chamber has a rod slidably extending through a bore in the cylinder for connection to the lower die holder. A lower piston having a head reciprocally retained within the lower chamber has a rod slidably extending through a bore in the partition for abutment with a head of the upper piston. The two pistons are biased to a retracted position by a return spring, preferably comprising a plurality of stacked disc springs. The second piston also includes an axial bore for providing fluid communication between the upper and lower chambers when fluid is supplied to the cylinder to move the pistons and, thus, the lower die toward the upper die to swage a workpiece.

The lower chamber of the cylinder further includes a cylindrical end cap opposite the partition for closing off the lower chamber. The end cap has external threads adapted for threaded engagement with internal threads on the lower chamber. In one aspect of the invention, the external threads on the cylinder end cap are tapered outwardly such that the outer diameter of the end cap increases in a direction away from the open end of the cap. These tapered threads provide improved load distribution as compared to threads made in the conventional constant-pitch manner. The root radius of the internal threads on the lower chamber also is enlarged, with the crest of the threads on the end cap being machined off. This enlarged root radius and machined crest helps to prevent tool breakage from thread failure.

The dies are connected to the tool by die retainer plates at opposite ends of each die. The fasteners which secure the die retainer plates to the tool are provided with resilient means positioned between the plates and the fastener to allow for expansion of the fitting and movement of the plates during swaging without breaking off the fastener or damaging the plates. In one embodiment, the resilient means comprises three Belleville washers positioned in series between the head of the fastener and the outer surface of its corresponding retainer plate.

Repeated use of the swaging tool also will cause the tool to wear, especially at the location where the tongues fit within the grooves to connect the head to the cylinder. Since there is a slight clearance between the mating surfaces of the tongues and grooves, to permit relative sliding movement for assembly purposes, these surfaces will become roughened gradually during use. The amount of roughening advantageously can be used as a visual gauge to determine and evaluate tool wear.

Additional features of the swaging tool include tool insertion guides to prevent damage to the tool components during assembly of the tool. These insertion guides comprise sleeves having chamfered openings which fit over, for example, the cylinder to facilitate insertion of the upper piston without damaging or otherwise nicking the piston against the tool cylinder. The tool also may be provided with a two-axis swivel for enabling the tool to be rotated in a plane coinciding with the axis of the cylinder, as well as enabling the tool to follow a cylindrical path around the axis of the swivel. The swivel allows the tool to be oriented at virtually any direction and greatly improves the ability of the tool to swage a fitting where space is limited.

Other features and advantages of the present invention will become apparent from the following detailed description, taking in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a perspective view of a swaging tool embodying the features of the present invention;

FIG. 2 is a longitudinal view, partly in cross-section, showing a fitting and associated tubing for swaging by the tool;

FIG. 3 is a perspective view, similar to FIG. 1, with the head of the tool removed for receiving the fitting;

FIG. 5 is an exploded cross-sectional elevational view illustrating a tool insertion guide for facilitating insertion of a return spring and upper piston in the tool cylinder during assembly of the tool;

FIG. 6 is another exploded cross-sectional elevational view showing another tool insertion guide for facilitating insertion of a lower piston in an end cap defining the lower end of the tool cylinder;

FIG. 7 is another exploded, cross-sectional elevational view showing a partition being assembled onto the rod of the lower piston and end cap assembly of FIG. 6;

FIG. 9 is a cross-sectional elevational view of retainer plates for securing the dies to the tool;

FIG. 10 is a perspective view of an alternative embodiment of the tool cylinder; and FIG. 11 is an exploded cross-sectional view taken from the section in FIG. 4 designated by the double-headed arrow 11.

DETAILED DESCRIPTION OF THE PREFERRED EMBODIMENT

Figure 4:
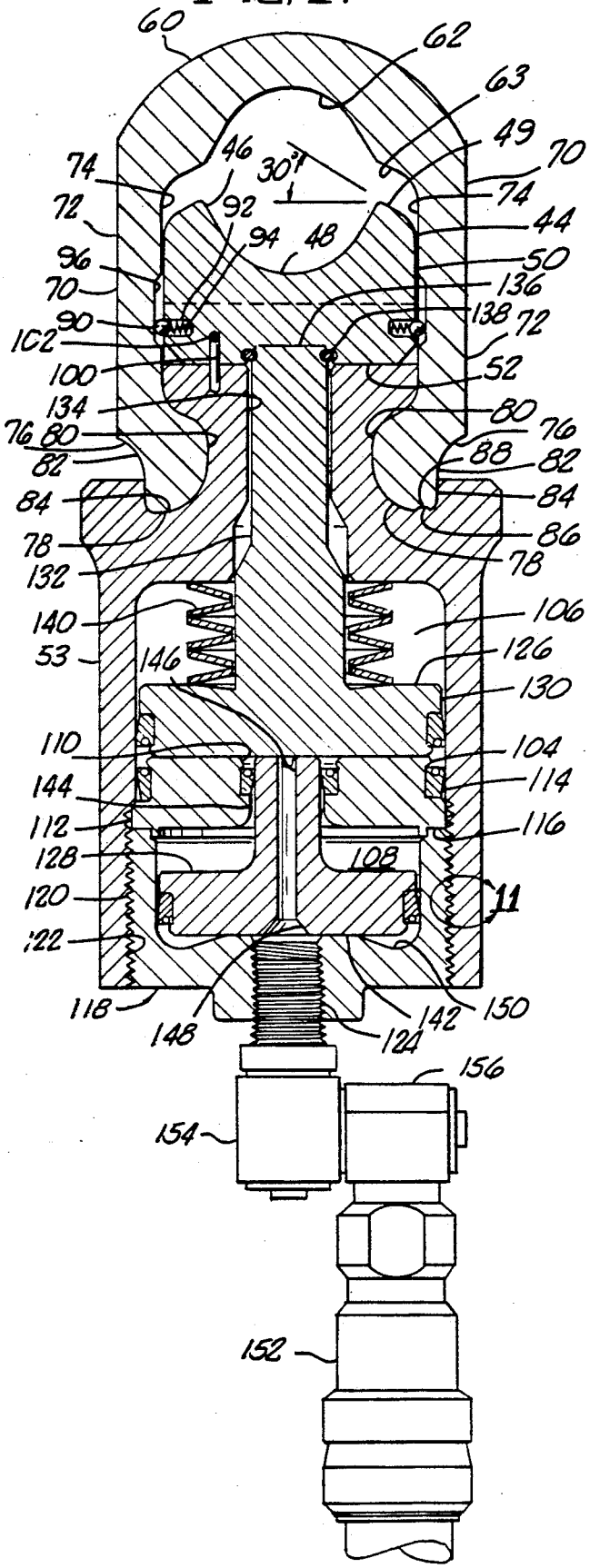
FIG. 4 is an enlarged cross-sectional elevational view of the tool, showing the principal components of the tool, but with the dies removed for purposes of clarity.

As shown in the accompanying drawings, the present invention is embodied in a swaging tool, indicated generally by the reference numeral 10, for use in swaging a fitting 12 and joining two tubes 14 and 16 together. The swaging tool comprises a lower die 18 adapted to be moved toward an upper die 20 to swage the fitting. As shown in FIG. 2, the fitting 12 comprises a sleeve for receiving the ends of the two tubes 14 and 16 and, when swaged by the tool, for joining the two tubes together. Before swaging, the fitting 12 has a smooth, cylindrical inner wall 22 and an irregularly shaped outer wall 24, as shown in the right portion of FIG. 2. The irregularly shaped outer wall 24 has an annular groove 26 of reduced diameter adjacent to each end of the fitting. Extending outwardly from the groove 26 are a flat annular ridge 28 and an inwardly tapering nose 30 that extends to the end of the fitting 12. The flat surface of the ridge 28 is designed to prevent relative rotation of the tube 16 and fitting 12 after the swaging has been completed.

In the swaging operation, the fitting 12 is compressed inwardly by the dies 18 and 20 of the swaging tool 10 so that the fitting is given an irregular configuration along its inner wall 22 that grips the tube tightly. The left portion of FIG. 2 illustrates the fitting 12 after the swaging operation has been completed, with the annular ridge 28 having been forced inwardly to form an annular indentation on the inner wall 22 of the fitting. The tube 14 is correspondingly swaged to a configuration matching the inner wall 22 of the fitting, thereby providing a permanent leak-proof coupling of the two tubes 14 and 16.

With reference to FIGS. 1–2, the swaging tool 10 of this invention includes the pair of identical dies 18 and 20 comprising unitary members having slots extending inwardly from either end to allow radial compression of the dies. Specifically, and referring to the lower die 18 for purpose of illustration, each die 18 and 20 has a curved surface 34 for receiving a portion of the fitting 12, including three parallel longitudinal slots 36 extending through the surface inwardly from the left end of the die to a location adjacent to the right end. There are additional and similar parallel longitudinal slots 38 through the curved die surface 34 extending inwardly from the right end to a location adjacent to the left. These two sets of slots 36 and 38 extending inwardly from opposite ends of the die provide elongated bendable elements 40 allowing compression of the dies in a radial direction. It will be understood that more than three slots 36 and 38 may be provided in each die 18 and 20 if desired. The outer ends of each die also have a beveled portion 42 that flares radially outwardly to its corresponding end. Dies having these and other desirable features are disclosed in U.S. Pat. No. 3,848,451. The swaging tool 10 of the present invention utilizes these dies, but they need not be explained further to understand the invention.

Referring now to FIGS. 1, 3 and 4, the lower die 18 is mounted within a die holder 44 having an upper surface 46 with a central portion which is contoured as a substantially cylindrical segment 48 for receiving the curved die 18, and a tapered outer portion 49 on opposite sides of the central cylindrical segment 48 (also see FIG. 4). The die holder 44 also includes four planar sides 50 and a planar base 52 for connection to the tool cylinder 53. The lower die 18 is secured to the die holder 44 by a pair of flat die retainer plates 54 which engage the opposite flat end walls of the die holder. A pair of screws 56 at each end of the retainer plates 54 fastens the plates to the lower die 18. The central upper edges of the plates are provided with inwardly extending flanges 58 which over lap and fit against the beveled portions 42 at the ends of the lower die 18 to ensure that the lower die is retained securely by the die holder 44.

The upper die 20 is received within a substantially U-shaped head 60. The head 60 has a substantially cylindrical central portion 62, similar to the central cylindrical segment 48 of the die holder 44, for receiving the curved upper die 20. A pair of tapered outer shoulders 63 on opposite sides of the cylindrical central portion 62 of the head 60 are adapted to mate with and engage the tapered outer portions 49 on the die holder 44 during the swaging operation. The angle of these tapered surfaces 49 and 63 with respect to the transverse axis of the tool 10 is about 30° (see FIG. 4). In the prior art tools, these surfaces were horizontal and resulted in undesirably high stress concentration upon contact between the surfaces during swaging. This caused premature tool breakage. To avoid premature breakage, the prior art tool was reinforced in this area, which made it larger and heavier. The improved tapered tool surfaces 49 and 63 of the preferred embodiment result in substantially uniform stress distribution and, therefore, less likelihood of tool breakage. Moreover, it advantageously allows the tool to be smaller and lighter because the tool 10 does not need to be reinforced in that area.

A pair of die retainer plates 64 are connected to opposite ends of the head 60 by screws 66 for securing the upper die 20 within the head. Each of the upper die retainer plates 64 has an inwardly extending flange 68 which overlaps and fits against the beveled portions 42 at the ends of the upper die 20 to securely hold the die within the head 60. As shown in FIG. 9 and explained in further detail below, a special washer is interposed between the heads of the screws and the outer surface of the upper die retainer plates to prevent the screws from breaking or damage to the retainer plates caused by expansion of the fitting during the swaging operation.

The head 60 has two parallel legs 70 extending from the tapered outer shoulders 63 and the central cylindrical portion 62. These legs 70 have flat, parallel inner and outer surfaces 72 and 74 which terminate in inwardly extending tongues 76 at their free ends. The tongues 76 have curved tips 78 and curved inner surfaces 80, and substantially flat, parallel outer surfaces 82 that are closer to each other than the flat, parallel outer surfaces 74 of the legs 70. The tongues 76 are adapted to be received within grooves 84 in the cylinder 53 having a configuration that matches the configuration of the tongues 76. These grooves 84 extend in a direction transverse to the longitudinal axis of the cylinder 53. To attach the head 60 directly to the cylinder 53, the ends of each tongue 76 are inserted with a sliding motion into the corresponding grooves 84 until the upper die 20 in the head 60 is aligned directly over the lower die 18.

The tongue 76 and groove 84 attachment means of the head 60 and cylinder 53 described above advantageously enables a direct connection of the head to the cylinder. Thus, no intermediate posts, nuts or other components are needed to make the connection. This sliding and direct connection between the head 60 and cylinder 53 therefore eliminates several extra parts common to known prior art tools. This results in a more compact and lightweight tool, in terms of both axial tool length and overall tool diameter. The connection between the two components also is very secure and can be achieved rapidly. Further advantages of the sliding connection of the head 60 to the cylinder 53 are described below.

In accordance with the present invention, head alignment means are provided for aligning the head 60 with respect to the cylinder 53 so that the head is connected to the cylinder in the proper orientation each time. Proper orientation of the head with respect to the cylinder is important because the upper and lower dies 20 and 18 carried by the head 60 and cylinder 53, respectively, must be in a correct orientation each time to ensure proper swaging of the fitting 12. If, for example, the upper die 20 is positioned in a reverse orientation with respect to the lower die 18, incomplete or improper swaging of the fitting 12 could occur.

The head alignment means comprises a rib 86 extending preferably along the base of the groove 84 and a trough 88 extending preferably along the tip 78 of the corresponding tongue 76. During connection of the head 60 to the cylinder 53, the rib 86 is adapted to be received in the trough 86 as the tongue 76 moves into sliding engagement with the groove 84. Since the rib 86 and trough 88 combination is located on only one of the tongues 76 and its corresponding groove 84, it is impossible to reverse the orientation of the head 60, and thus the dies 18 and 20, when assembling the head 60 to the cylinder 53 to swage a fitting 12. If one attempted to connect the head 60 to the cylinder 53 in the wrong orientation, the rib 86 in the groove 84 would block the tongue 76 without the trough 88 from entering. Thus, correct orientation of the dies 18 and 20 is ensured each time the head 60 is assembled to the cylinder 53.

The flat, parallel sides 50 of the die holder 44 fit substantially complimentary between the inner surfaces 72 of the legs 70 of the head 60. The die holder 44 is retained between the legs 70 by a ball 90 that fits within an opening 92 in the die holder biased outwardly by a spring 94 into a groove 96 in the inner surface 72 of the leg 70, as shown in FIG. 4. The groove 96 extends in an axial direction a sufficient distance to allow the lower die 18 and die holder 44 to move toward the upper die 20 during swaging while the head 60 and upper die 20 remain stationary. The base 52 of the die holder 44 abuts the upper surface 98 of the cylinder 53 and has a configuration that matches the base of the die holder.

Another aspect of the swaging tool 10 of the present invention is the provision of means for aligning the lower die 18 and die holder 44 with respect to the cylinder 53 in the proper orientation. For the same reasons discussed above in relation to the head alignment means, it is just as important when mounting the lower die 18 and die holder 44 to the cylinder 53 that the lower die be in the proper orientation with respect to the upper die during the swaging operation. This lower die alignment means comprises a pin 100 connected to and projecting from the upper flat surface 98 of the cylinder 53 at a predetermined location. This location may be virtually anywhere on the cylinder upper surface 98, except of course at its center, and preferably, far enough away from the center to facilitate positioning of the die holder 44 onto the cylinder 53. Any position of the pin 100 adjacent to one of the edges of the cylinder top surface 98 is suitable. A hole 102 is provided in the base 52 of the die holder 44 for receiving the pin 100 when the die holder is assembled onto the cylinder. The length of the pin 100 and the depth of the hole 102 are great enough so that as the die holder 44 is moved away from the cylinder 53 during swaging, the pin still will be completely within the hole. The hole 102 is located in the die holder base 52 such that when the pin 100 is received within the hole and the edges of the die holder base 52 are aligned with the edges of the cylinder top surface 98, the lower die 18 will be in the proper orientation on the cylinder 53. Thus, guesswork by the factory assembler and swaging tool operator is eliminated concerning the question of proper die alignment.

The pin 100 and hole 102 combination discussed above also prevents undesirable rotation of the die holder 44 with respect to the cylinder 53 which may occur during the swaging operation. In an alternative embodiment shown in FIG. 10, a tapered shoulder 103 projecting from the upper flat surface 98 of the cylinder 53 is designed to abut against one end of the die holder 44 to prevent rotation of the die holder relative to the cylinder. These anti-rotation features are intended to increase tool life and reliability of the swaging operation.

To accomplish swaging of the fitting 12, the lower die 18 is moved toward the upper die 20 by piston means within the cylinder 53. This piston means is shown best in FIG. 4 and comprises a partition 104 in the cylinder 53 defining a first or upper cylinder chamber 106 and a second or lower cylinder chamber 108. The partition 104 is a cylindrical disk having a central axial hole 110. The outer circumferential edges of the partition 104 have an outwardly extending annular shoulder 112 which fits against an inwardly extending annular shoulder 114 on the inside surface of the cylinder marking the entrance to the upper chamber 106. The partition 104 is secured against the cylinder shoulder 114 between the two chambers 106 and 108 by the open end 116 of a cylindrical end cap 118 closing off the outer end of the cylinder 53. The open end 116 of the end cap 118 has an externally threaded outer surface 120 adapted for threaded engagement with an internally threaded surface 122 at the outer end of the cylinder 53 in the region of the lower chamber 108. Thus, when the end cap 118 is fully screwed into the cylinder 53, it traps the partition 104 between its open end 116 and the inwardly extending shoulder 114 on the inner surface of the cylinder. A threaded hole 124 at the center of the end cap 118 permits the introduction of fluid to the cylinder 53 to allow pneumatic or hydraulic operation of the swaging tool 10, as desired. It also should be noted that the inner cylindrical surface of the end cap 118 is smooth and comprises the sidewall of the lower chamber 108.

A double piston arrangement is provided in the cylinder 53, comprising a first or upper piston 126 in the upper chamber 106 and a second or lower piston 128 in the lower chamber 108. More specifically, the upper piston 126 has a head 130 reciprocally retained within the upper chamber 106 and a rod 132 extending upwardly through an axial hole 134 in the cylinder 53 for connection to the die holder 44 carrying the lower die 18. The upper end of the rod 132 is received within a recess 136 in the die holder base 52 and is connected to it by a plurality of snap ring springs 138. A return spring 140 is positioned in the upper chamber 106 around the rod 132 and between the upper piston head 130 and the upper end of the upper chamber 106 The return spring 140 biases the upper piston 126 against the partition 104 in the absence of fluid pressure in the cylinder 53. Thus, at the completion of each swaging operation, in which the upper piston 126 moves upwardly to move the lower die 18 toward the upper die 20, the lower die 18 will be retracted against the partition 104 by the return spring 140. The lower piston 128 has a cylindrical head 142 reciprocally retained within the lower chamber 108 and a rod 144 extending upwardly through the central axial hole 110 in the partition 104. The end of the lower piston rod 144 abuts the upper piston head 130. An axial passageway 146 extending completely through the lower piston 128 permits fluid communication between the lower chamber 108 and the upper chamber 106.

The swaging tool 10 utilizes the double piston arrangement described above for enhanced force. Fluid enters the lower chamber 108 through the end cap hole 124 and travels through the passageway 146 to the region behind the upper piston 126. The passageway has a beveled entrance 148 to facilitate upward movement of the lower piston 128 during initial introduction of fluid. An annular recessed area 150 in the end cap 118 underneath the lower piston head 142 enables fluid to more rapidly build up behind the head to further facilitate upward piston movement. As the fluid reaches the upper piston 126 via the passageway 146, it initially builds up in a small area behind the head 130 and, upon upward movement of the lower piston 128, which in turn lifts the upper piston 126 from the partition 104, is then dispersed rapidly behind the entire head 130. The foregoing piston structure advantageously utilizes the entire surface area of the head of each piston. Importantly, this maximizes piston force without requiring any increase in fluid pressure. As a result, a smaller size piston arrangement may be employed, which translates into a more compact and lighter tool, in terms of overall tool diameter.

In order to achieve the most compact and lightweight tool possible, it was discovered that a conventional helical spring was not the most suitable device for use as the return spring 140. Instead, it was found that a small stack of disc springs could carry the same load in much less space than a significantly larger helical spring. The stack of disc springs 140 in the present invention is smaller in diameter, lighter in weight, can carry higher loads and provides faster return of the upper piston 126 than a conventional helical spring. Again, this contributes to the reduced size and weight of the swaging tool 10 of this invention.

The versatility of the swaging tool 10 is further enhanced by a two-axis swivel 152 threadedly connected to the base of the cylinder 53 at the internally threaded hole 124 in the end cap 118, as shown best in FIG. 4. The swivel 152 includes a first swivel joint 154 permitting the tool 10 to rotate in a plane that coincides with the axis of the cylinder 53. A second swivel joint 156 allows the tool 10 to follow a cylindrical path around the longitudinal axis of the swivel 152. Thus, the swivel 152 permits the tool 10 to be directed in practically any direction. This feature has special utility, for example, when swaging in cramped quarters or when direct axial access to the fitting 12 is not possible.

Repeated use of the swaging tool 10 and consequent application of relatively high pressure to compress the dies 18 and 20 gradually will cause the tool to wear. One example of such wear is due to the axial stresses exerted on the legs 70 of the head 60, especially at the location where the tongues 76 fit within the grooves 84 to connect the head 60 to the cylinder 53. Since there is a slight clearance between the mating surfaces of the tongues 76 and grooves 84, to permit their sliding movement relative to each other for assembly, each swaging operation will cause the tongues to rub against the grooves and result in some tool wear. Recognizing tool wear is important, because it enables replacement or repair of worn parts before a major problem occurs. Extreme tool wear also may result in incompletely or defectively swaged fittings. In accordance with the present invention, therefore, the outer surfaces of the tongues 76 in the area where they engage the grooves 84 will become worn down and roughened during use of the tool 10 to indicate tool wear. This roughened area has been designated by the reference numeral 158 for purpose of reference. The area 158 is subject to being worn down and roughened by the limited amount of friction or rubbing that occurs between the tongues 76 and grooves 84 during swaging. When the area 158 has been sufficiently worn down and roughened, it may be a signal to replace or repair certain components of the tool or, perhaps, the tool itself.

Another advantage of the tool 10 of the present invention is its provision of tool insertion guides for preventing damage to the tool components during assembly of the tool. These tool insertion guides are shown in FIGS. 5–6 and facilitate assembly of the cylinder components of the tool in the manner shown in FIGS. 5–8. The first cylinder assembly step is shown in FIG. 5 and involves inserting the stack of disc springs 140 on the upper piston rod 132, and then inserting the upper piston 126 into the open end of the cylinder 53. The tool insertion guide 160 shown in FIG. 5 prevents the head 130 of the upper piston 126 from being damaged or nicked against the cylinder 53 upon its insertion. The tool insertion guide 160 comprises a substantially cylindrical sleeve having a thin walled inner end 162 adapted for insertion into and fitting against the internal threads 122 of the lower chamber 108. A thick walled outer end 164 of the insertion guide 160 extends out of the lower chamber 108 and over the open end of the cylinder 53. The entrance to the sleeve 160 at its outer end has a chamfered portion 166 to further facilitate insertion of the upper piston 126 into the cylinder 53. It is also is noted that the inside diameter of the thin walled inner end 162 of the insertion guide 160 is substantially the same as the inner diameter of the upper chamber 106, so that a smooth transition is provided between the region defining the lower chamber 108 of the cylinder and the upper chamber 106 thereof The insertion guide 160 may be constructed from free machined steel or other suitable materials which will not damage the upper piston 126. After insertion, the insertion guide 160 may be removed and retained for further use.

The next step of assembling the cylinder components of the tool 10 is shown in FIG. 6, and involves inserting the lower piston 128 into the open end 116 of the end cap 118. Again, another tool insertion guide 168 facilitates this assembly process. Specifically, the second tool insertion guide 168 comprises a substantially cylindrical sleeve adapted to be placed on the open end 116 of the externally threaded end cap 118. The inner diameter of the sleeve 168 is substantially the same as the inner diameter of the smooth walled interior of the end cap 118. The entrance to the insertion guide also has a chamfered portion 170 to further facilitate insertion of the lower piston 128 into the cylindrical end cap 118. After the lower piston 128 has been inserted into the end cap 118 and the insertion guide 168 removed, the partition 104 is assembled on the rod 144 of the lower piston 128, as shown in FIG. 7. The insertion guide 168 thereafter may be retained for further use.

Figure 8:
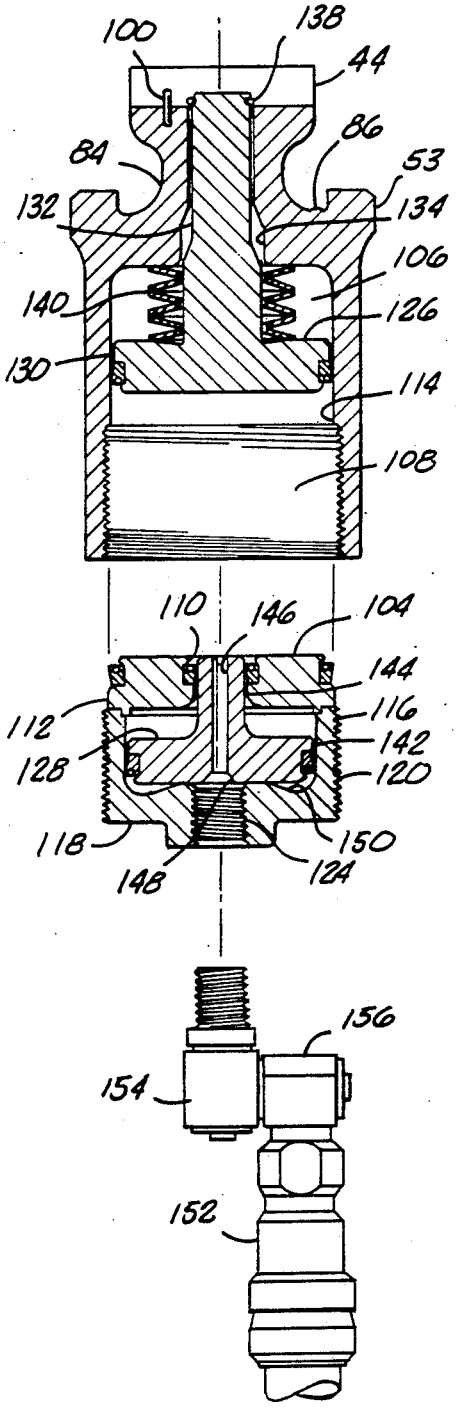
FIG. 8 is another exploded elevational view, partly in cross-section, showing final assembly of the cylinder components of the tool, including a two-axis swivel for connection to the tool cylinder.

The finally assembly step is shown in FIG. 8, in which the end cap 118 carrying the lower piston 128 and partition 104 is screwed into the cylinder 53 until the open end 116 of the end cap 118 has trapped the partition 104 against the inwardly extending shoulder 114 of the cylinder defining the entrance of the upper chamber 106. Upon completion of this assembly step, the two-axis swivel 152 may be connected to the cylinder end cap 118 and connected to appropriate hydraulic or pneumatic means (not shown) for providing fluid pressure to the tool 10.

Yet another feature of the invention is the employment of tapered threads on the external threads 120 of the end cap 118. It is well known that a substantial improvement in thread load distribution can be obtained by tapering the thread of either a male or female threaded component in a proper fashion, as compared to the conventional constant-pitch manner. The tapered threads result in a substantial improvement in the strength of the threaded connection, especially ones that normally are conducive to brittle plastic flow and, thus, liable to result in brittle fractures, such as are encountered with dynamic loads in swaging tools. Accordingly, the external threads 120 on the cylindrical end cap 118 in the preferred embodiment are tapered outwardly such that the outer diameter of the end cap 118 increases in a direction away from the open end 116 of the end cap 118, with the internal threads 122 on the cylinder 53 being made in the conventional constant-pitch manner.

Other modifications to the external threads 120 of the end cap 118 and the internal threads 122 on the cylinder 53, which are shown in FIG. 11, include providing the internal threads 122 on the cylinder 53 with a root radius 171 that is larger than the UNJ standard. In the preferred embodiment, the root radius 171 for the threads 122 on the cylinder 53 is between approximately 0.0175 and 0.020 inches, where the internal diameter in the area of the threads is approximately 2.375 inches. The UNJ standard root radius for such threads normally would be approximately 0.0125 to 0.0150 inches. Therefore, the root radius 171 of the preferred embodiment is approximately 40% percent greater than the usual root radius. A further modification involves machining off the crest 173 of the outwardly tapered external threads 120 on the end cap 118. In the preferred embodiment being discussed, approximately 0.029 to 0.031 inches of the crest are machined off. Otherwise, the outwardly tapered threads 120 of the end cap 118 follow the UNJ standards. The more generous root radius 171, in combination with the reduced size crest 173 (and the tapering of the threads 120 on the end cap 118), substantially improves the thread load distribution, increases the strength of the threaded connection, and reduces the likelihood of tool breakage.

A majority of the components of the tool 10 of this invention are constructed from high tensile strength materials, such as stainless steel or maraging steel, for example. These components include the lower die 18, upper die 20, die holder 44, tool cylinder 53, head 60, pin 100, partition 104, end cap 118, upper piston 126 and lower piston 128. The preferred method of manufacturing many of these components, such as the cylinder 53 and the head 60, is by an electric discharge machine (EDM). The die retainer plates 54 and 64 can be made from cold rolled steel, and the tool insertion guides 160 and 168 can be made from free machined steel. The return spring 140 can be made of spring steel.

Operation of the swaging tool 10 is as follows. A fitting 12 to be swaged is positioned between the upper and lower dies 18 and 20, with the lower die 18 in the retracted position. This may be done by slidably removing the head 60 from the cylinder 53, positioning the fitting in the region of the lower die 18, and then replacing the head. The flanges 58 and 68 of the die retainer plates 54 and 64 have corners extending into the die opening which are engaged by the end of the fitting 12 as the fitting is put into final position before swaging. Thus, the retainer plates 54 and 64 act as stops that locate the fitting 12 in the proper position axially relative to the lower and upper dies 18 and 20. After the fitting 12 has been properly positioned, pressurized fluid is admitted into the cylinder 53 through the axial hole 124 in the end cap 118. As explained in detail above, this moves the pistons 126 and 128 upwardly and, thus, moves the lower die 18 toward the upper die 20. Compression of the dies 18 and 20 in this manner continues until the tapered surfaces 49 and 63 have contacted each other, after which the swaging operation is terminated. When the fluid pressure is released and the return spring 140 moves the pistons 126 and 128 to their retracted positions, the fitting 12 may be removed from the tool 10 and the swaging operation is complete.

During the swaging operation, expansion of the fitting 12 in an axial direction relative to the tubes 14 and 16 occurs. This creates a force against the die retainer plates 54 and 64 which, in some instances, becomes so great that the plates are deformed or otherwise damaged, or the screws 56 and 66 securing the plates to the tool are stripped or broken off To prevent this from happening, the tool 10 is provided with resilient means positioned between the die retainer plates 54 and 64 and the screws 56 and 66 to allow for expansion of the fitting 12 during swaging without breaking off the screws or damaging the retainer plates. The resilient means preferably comprises at least one washer 172 positioned between the head 174 of the screw 66 and the outer surface of its corresponding retainer plate 64. In the preferred embodiment, the washer 172 comprises three Belleville washers arranged in series, as illustrated in FIG. 9. Thus, when the fitting 12 expands during swaging and exerts force against the retainer plates, the Belleville washers 172 acts as a buffer permitting some movement of the plates with respect to the tool 10 and thereby substantially reduces the possibility of tool damage.

In some instances, the assembled tool 10 will be inserted directly onto the fitting 12 if one of the tubes 14 or 16 to be swaged has a free end to permit access in this manner. In other instances, it will be necessary to remove the head 60 from the tool 10 to position the head around the fitting 12, between the free ends of the two legs 70. In the latter situation, the simple two-piece head-cylinder direct sliding connection permits rapid assembly of the tool and is especially useful in swaging fittings in difficult-to-access locations. After swaging, the head 60 may be rapidly removed from the tool 10 to swage the next fitting.

From the foregoing, it will be appreciated that the swaging tool 10 of this invention is adapted to swage fittings 12 for connecting two tubes 14 and 16, especially fittings located in tight or difficult-to-access areas. Simple yet effective means are provided for ensuring proper connection, alignment and orientation of the upper die 20 with respect to the lower die 18, as well as other important features to facilitate use and assembly of the tool, thereby contributing to a much lighter and smaller swaging tool than heretofore developed.

While a particular form of the invention has been illustrated and described, it will be apparent that various modifications can be made without departing from the spirit and scope of the invention Accordingly, it is not intended that the invention be limited, except as by the appended claims.

I claim:

1. A swaging tool, comprising:

a first die;

a second die adapted to be moved toward the first die to swage a workpiece therebetween;

a head for holding the first die with respect to the second die during swaging;

a cylinder for supporting the second die and having means for moving the second die toward the first die;

connecting means for connecting the head to the cylinder, the connecting means comprising a pair of tongues on the head adapted to be moved into sliding engagement with a pair of grooves on the cylinder, the tongues and grooves extending in a direction substantially transverse to the longitudinal axis of the cylinder; and head alignment means associated with one of the tongues and its corresponding groove for preventing reversal of the orientation of the first die with respect to the second die and thereby properly aligning the dies in the same orientation each time the head is connected to the cylinder, such that the head may be connected to the cylinder from either side of the cylinder.

2. The swaging tool of claim 1, wherein the head alignment means comprises a rib extending along the length of one of the groove sand a trough extending along the length of a corresponding tongue, the rib being adapted to be moved into sliding engagement with the trough upon assembly of the head to the cylinder.

3. The swaging tool of claim 1, wherein a portion of each tongue in the area where it engages the groove is adapted to be worn down or roughened during use of the tool to indicate tool wear.

4. The swaging tool of claim 1, further comprising means for aligning the second die with respect to the cylinder in the proper orientation.

5. The swaging tool of claim 4, wherein the means for aligning the second die with respect to the cylinder comprises:

a die holder on an upper surface of the cylinder for holding the second die;

a pin connected to the cylinder and projecting from its upper surface at a predetermined location, the pin being adapted to be received in a hole in the die holder such that the die and die holder are assembled onto the cylinder in the same orientation each time.

6. The swaging tool of claim 1, further comprising means for inhibiting rotation of the second die with respect to the cylinder, comprising a die holder on an upper surface of the cylinder for holding the second die; and a shoulder extending from the upper surface of the cylinder adapted for abutting engagement with the die holder to inhibit its rotation with respect to the cylinder.

7. The swaging tool of claim 1, wherein the means for moving the second die toward the first die comprises piston means.

8. The swaging tool of claim 7, wherein the piston means comprises:

a partition in the cylinder defining a first chamber at one end of the cylinder adjacent to the second die and a second chamber at the other end thereof;

a first piston having a head reciprocally retained within the first chamber and a rod slideably extending through a bore in the cylinder for connection to the second die;

a return spring positioned in the first chamber between the one end of the cylinder and the head of the first piston;

a second piston having a head reciprocally retained within the second chamber and a rod slideably extending through a bore in the partition for abutment with the head of the first piston, the second piston further including an axial bore therethrough for providing fluid communication between the first and second chambers; and means for supplying fluid into the second chamber to move the pistons toward the one end of the cylinder and thereby move the second die toward the first die to swage a workpiece.

9. The swaging tool of claim 8, wherein the return spring comprises a plurality of stacked disc springs.

10. The swaging tool of claim 8, wherein the second chamber in the cylinder further includes a cylindrical end cap opposite the partition for closing off the second chamber, the end cap including external threads adapted for threaded engagement with internal threads on the second chamber.

11. The swaging tool of claim 10, further comprising tool insertion guides to prevent damage to the tool components during assembly of the tool.

12. The swaging tool of claim 11, wherein one of the tool insertion guides comprises a cylindrical sleeve having a thin walled inner end inserted into and fitting against the internal threads of the second chamber and a thick walled outer end extending out of the second chamber, the entrance to the sleeve at the outer end being chamfered to facilitate insertion of the first piston into the first chamber of the cylinder.

13. The swaging tool of claim 11, wherein another of the tool insertion guides comprises a cylindrical sleeve adapted to be placed on the open end of the externally threaded end cap, the inner diameter of the sleeve being substantially the same as the inner diameter of the end cap, the entrance to the sleeve being chamfered to facilitate insertion of the second piston into the cylindrical end cap.

14. The swaging tool of claim 10, wherein the internal threads on the second chamber of the cylinder have a root radius that is larger than the UNJ standard root radius.

15. The swaging tool of claim 10, wherein the internal threads on the second chamber of the cylinder have a root radius that is approximately 25 percent to 50 percent larger than the UNJ standard root radius.

16. The swaging tool of claim 10, wherein the internal threads on the second chamber of the cylinder have a root radius that is approximately 40 percent larger than the UNJ standard root radius.

17. The swaging tool of claim 10, wherein the external threads on the cylindrical end cap are tapered outwardly such that the outer diameter of the end cap increases in a direction away from the open end of the cap.

18. The swaging tool of claim 10, wherein the crest of the external threads on the cylindrical end cap are removed.

19. The swaging tool of claim 1, further comprising:

a pair of die retainer plates at opposite ends of each die for retaining the dies within the tool;

a fastener for securing the die retainer plates to the tool; and resilient means positioned between the die retainer plates and the fastener to allow for expansion of the workpiece during swaging without breaking off the fastener or damaging the retainer plates.

20. The swaging tool of claim 19, wherein the resilient means comprises a Belleville washer positioned between the head of at least one of the fasteners and the outer surface of its corresponding retainer plate.

21. The swaging tool of claim 19, wherein the resilient means comprises three Belleville washers positioned in series between the head of at least one of the fasteners and the outer surface of its corresponding retainer plate.

22. The swaging tool of claim 1, further comprising swivel means for enabling the tool to be rotated in a plane coinciding with the axis of the cylinder.

23. The swaging tool of claim 1, further comprising swivel means for enabling the tool to follow a cylindrical path around the axis of the swivel means.

24. The swaging tool of claim 1, further comprising swivel means for enabling the tool to be rotated in a plane coinciding with the axis of the cylinder as well as enabling the tool to follow a cylindrical path around the axis of the swivel means.

25. The swaging tool of claim 1, further comprising a die holder on the cylinder having a central portion for receiving the second die and a pair of tapered outer surfaces on opposite sides of the second die adapted, at the end of the swaging operation, to engage a complementary pair of tapered outer shoulders on opposite sides of the first die in the head.

26. The swaging tool of claim 25, wherein the angle of the tapered surfaces on the die holder and the angle of the tapered shoulders on the head are approximately 15 degrees to 45 degrees with respect to the transverse axis of the tool.

27. The swaging tool of claim 26, wherein the angle of the tapered surfaces on the die holder and the angle of the tapered shoulders on the head are approximately 30 degrees with respect to the transverse axis of the tool.

* * * * *